United States Patent [19]

Bandzul

[11] Patent Number: 5,014,451

[45] Date of Patent: May 14, 1991

[54] TRUCK MOUNTED SNOW PLOW SUPPORT CAP

[76] Inventor: John H. Bandzul, 287 Oak St., Clinton, Mass. 02110

[21] Appl. No.: 510,089

[22] Filed: Apr. 17, 1990

Related U.S. Application Data

[63] Continuation-in-part of Ser. No. 369,027, Jun. 20, 1989, abandoned.

[51] Int. Cl.[5] ..... E01H 5/04

[52] U.S. Cl. ..... 37/231; 37/235

[58] Field of Search ..... 37/231, 232, 235, 236, 37/DIG. 11, DIG. 12, DIG. 13

[56] References Cited

U.S. PATENT DOCUMENTS

| | | | |
|---|---|---|---|
| 2,867,921 | 1/1959 | Brown | 37/235 X |
| 3,104,893 | 9/1963 | Torrey | 37/231 X |
| 3,150,884 | 9/1964 | Drott | 37/231 X |
| 3,214,138 | 10/1965 | Jocher et al. | 37/236 X |
| 3,828,449 | 8/1974 | Miceli | 37/232 X |
| 3,851,894 | 12/1974 | St. Pierre | 37/231 X |
| 4,304,056 | 12/1981 | Watson et al. | 37/231 X |

*Primary Examiner*—Dennis L. Taylor
*Assistant Examiner*—J. Russell McBee
*Attorney, Agent, or Firm*—Wolf, Greenfield & Sacks

[57] ABSTRACT

A rigid structural cap mounted on and extending horizontally between truck mounted snow plow support projections. The cap includes a flat horizontal top wall, a flat vertical front wall, flat vertical opposing side walls and bottom and rear structural walls.

12 Claims, 2 Drawing Sheets

TRUCK MOUNTED SNOW PLOW SUPPORT CAP

This is a continuation-in-part of copending application Ser. No. 0/369,027 filed on Jun. 20, 1989.

BACKGROUND OF THE INVENTION

It is common practice in snow belt areas to attach snow plows to the front of pick-up and other small trucks during the snow season, and to then remove the plows in the spring when the snow season is over. Generally, the attachment for the plow consists of a plow support bolted to the understructure of the truck. The plow support extends forwardly from the truck and terminates in a pair of spaced support projections located under and forward of the truck bumper. The height controlling mechanism for supporting the plow and for varying its height above the roadway is bolted to the support projections. The steering mechanisms for steering the plow are forward extending pivot support and hydraulically operated pistons which are also supported from the understructure of the vehicle.

When the plow is removed from the truck, the steering and height control mechanisms are removed without difficulty. To remove the plow support is an extensive job, as is its reinstallation in the fall. Most truck operators opt to leave the support on the vehicle, and this results in unsightly protrusion of the support projections from the front of the truck. These projections create a hazard to people and to other vehicles because they are positioned in front of and below the truck's bumper. Furthermore, it is exposed to the weather, and will rust.

SUMMARY OF THE INVENTION

This invention overcomes the foregoing problems, and provides a snow plow support cap which not only enhances the appearance of the truck, but also provides protection against the hazzard of the support projections. In addition, the cap provides a useful platform or step enabling better service access to the truck's engine. The support cap is configured to be bolted to the support projections through the same holes used to bolt the plow elevation mechanism, and to permit the uninhibited operation of the plow steering mechanism.

THE DRAWINGS

For a clearer understanding of the nature of the advantages of the invention, reference should now be made to the following specification and to the accompanying drawings in which.

DETAILED DESCRIPTION OF THE DRAWINGS

Figure 1:
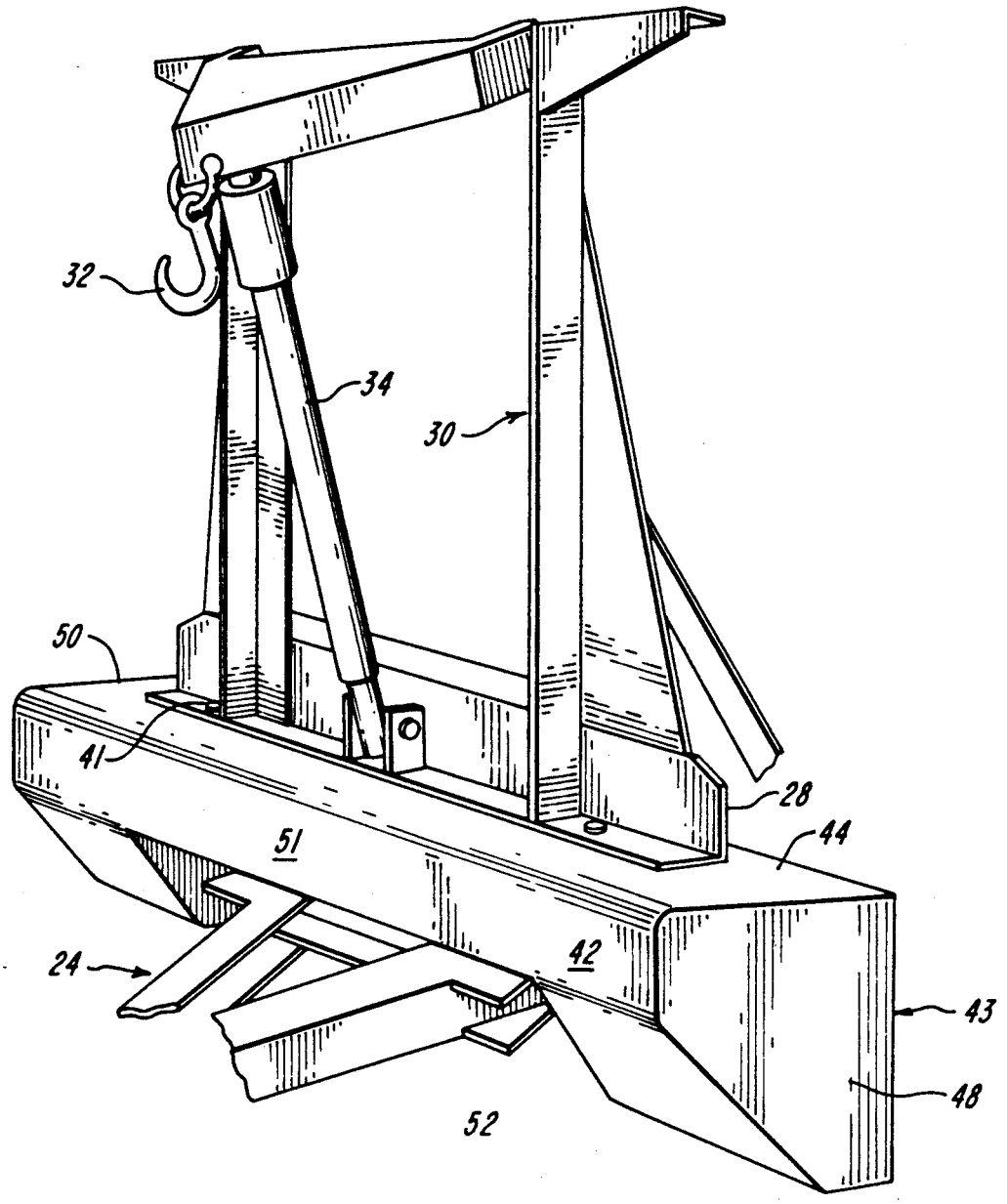
FIG. 1 is a view showing the plow support and the cap assembled.
Figure 2:
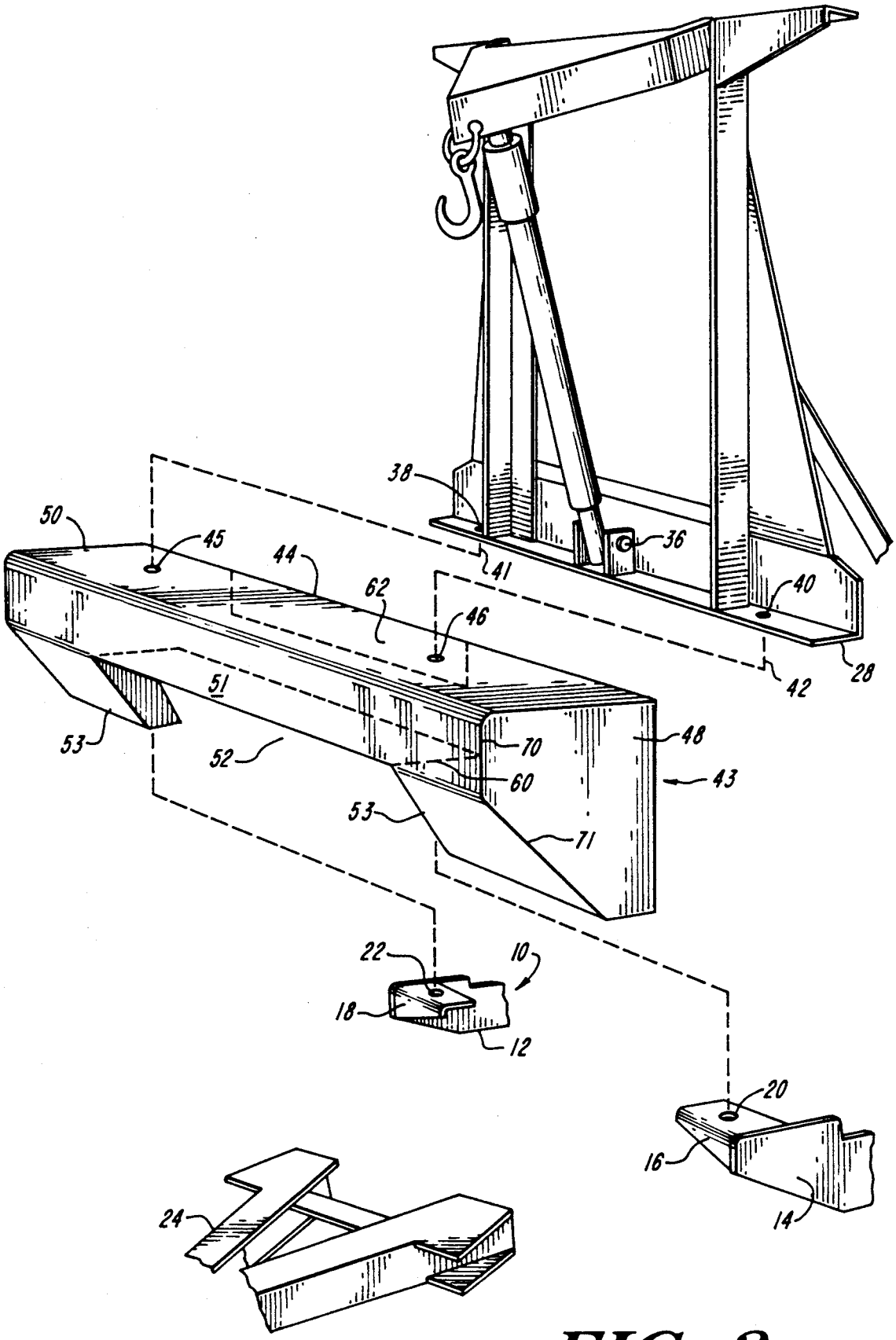
FIG. 2 is a view, partially in phantom, showing the plow support and the cap disassembled.

Referring to the drawings, I show a conventional plow support 10 which is mounted to the understructure of a modern pick-up truck (not shown). As best seen in FIG. 2, the support consists of a pair of structural support arms 12 and 14. While the arms 12 and 14 are shown broken away, it will be understood that these arms extend under the truck and are appropriately bolted to the understructure of the truck. The arms 12 and 14 terminate in angle iron projections 16 and 18. The projection 16 and 18 are provided with bolt holes

20 and 22 through which bolts may pass to secure the plow and its mechanisms in place. The projections 16 and 18 extend under and beyond the front bumper of the vehicle.

Also bolted to the under structure of the truck by means not illustrated, and extending forward therefrom and below the support projections 16 and 18 is the support 24 for the plow steering mechanisms. The center of the rear of the plow blade is pivoted (by means not shown) to the support 24, and the plow is conventionally steered by means of conventional hydraulically operated pistons (not shown).

The plow elevation mechanism is conventional and it comprises an L-shaped beam 28 which carries the framework 30 which in turn supports the plow hook 32 and the hydraulically operated piston 34 which is pivoted to the beam 28 at pin 36. The beam 28 is provided with bolt holes 38 and 40, spaced apart the same distance as the bolt holes 20 and 22 on the projections 16 and 18. All of the foregoing is conventional.

Normally, the snow plow elevation control mechanism is connected directly to the projections 16 and 18 by means of bolts 41 and 42. When the plow is not needed, as in the spring, the snowplow elevation control mechanism is removed from the truck along with the elevation and steering mechanisms. However, because of its normal location below the understructure of the truck, the support arms 12 and 14 are not conveniently removed, and most snow plow operators leave those members in place winter and summer, with the projections 16 and 28 extending under and forward of the trucks bumper.

As previously noted, the projections 16 and 18 constitute a hazard to persons passing in front of the truck, and to other vehicles because these elements are located in front of and below the vehicle bumper. In order to overcome these problems, I install a cap 43 on the plow support projections 16 and 18.

The cap 43 comprises a rigid structural member which includes a top wall 44, provided with spaced bolt holes 45 and 46. The bolt holes 45 and 46 are spaced the same distance as the holes 20 and 22 in the support projections 16 and 18. The cap also includes two vertical side walls 48 and 50, interconnected by a front wall 51. The edge of the vertical sidewalls 48, 50 adjacent the front wall 51 includes a partly vertical edge 70 and a partly angled edge 71. Front wall extensions 53 incline downwardly toward the motor vehicle. In the preferred embodiment, front wall extensions 53 project from the front wall 51 at a 45° angle. The front wall 51 is provided with an opening 52 to accommodate the positioning of the member 24 within the front wall of the cap.

When the plow is in place, the beam 28 of the elevation control mechanism is bolted to the projections 16 and 18 through the bolt holes 45 and 46 in the cap 43.

For improved structural stability, the cap may include bottom wall 60 and/or rear wall 62. Bottom wall 60 extends towards the truck in a plane substantially parallel to top wall 44. Rear wall 62 extends downward in a plane substantially parallel to front wall 51. Top wall 44, front wall 51, bottom wall 60 and rear wall 62 together define a hollow box shaped structure. The box shaped structure improves the inherent rigidity of the cap 43. This improved rigidity is particularly beneficial when the top wall 44 is to be used as a step or platform from which the user gains access to the difficult to reach engine compartment.

The present invention is preferably made by forming a single piece of metal, such as aluminum type 3003 into a cap of uniform thickness. Although aluminum is the preferred metal, other metals and alloys thereof can also be used as is known to those skilled in the art. Other materials such as hard plastics, composites and ceramics can also be used to form the cap according to the present invention. To provide sure footing when the user is standing on the cap, the cap surface may include diamond plate or other surface projections or attachments as is known to those skilled in the art to promote traction on flat surfaces.

IN SUMMARY

This invention provides a unique cap for the projections of a truck plow support, the cap providing a secondary bumper for the truck, a step or platform for enabling the convenient servicing of the truck's engine, a protective device and a decorative assembly which effectively conceals the unsightly projections of the plow support.

What is claimed is:

1. The combination comprising:

a motor vehicle having an end and a pair of plow support members extending outwardly from said end and terminating in respective spaced and aligned first ends thereof, said spaced and aligned first ends each having a portion including means for cooperating with means for securing said respective plow support members to a plow;

a hollow horizontally extending cap enclosing said spaced and aligned first ends, said hollow horizontally extending cap being spaced outwardly from said end; and means for securing said hollow horizontally extending cap to said spaced and aligned first ends.

2. The combination recited in claim 1 wherein said hollow horizontally extending cap includes a flat horizontal top wall, opposing side walls depending therefrom and a front wall extending from said flat horizontal top wall and said opposing side walls.

3. The combination recited in claim 2 wherein said front wall includes a flat vertical wall perpendicular to said flat horizontal top wall.

4. The combination recited in claim 3 wherein said opposing side walls includes vertical flat walls.

5. The combination recited in claim 3 wherein said hollow horizontally extending cap further includes a rear wall extending from said flat horizontal top wall, said rear wall being perpendicular to said flat horizontal top wall and parallel with said flat vertical front wall.

6. The combination recited in claim 3 wherein said hollow horizontally extending cap further includes a bottom wall extending from said flat vertical front wall, said bottom wall being perpendicular to said flat vertical front wall and parallel with said flat horizontal top wall.

7. The combination recited in claim 4 wherein each of said spaced and aligned first ends includes at least one wall parallel with and adjacent to at least one of said flat horizontal top wall, said flat vertical opposing side walls and said flat vertical front wall of said hollow horizontally extending cap.

8. The combination recited in claim 7 wherein said at least one wall includes said portion including means for cooperating with means for securing said respective plow support members to a plow.

9. The combination recited in claim 4 wherein the edge of said opposing side walls extending from said front wall includes a partly vertical and partly angled edge.

10. The combination recited in claim 9 wherein a portion of said front wall extending from said partly vertical and partly angled edge of each of said opposing side walls includes a vertical surface extending the length of said partly vertical edge and an angled surface extending the length of said partly angled edge.

11. The combination recited in claim 1 wherein said angled surface is angled 45 degrees from said vertical surface.

12. The combination comprising:

a motor vehicle having an end including a horizontally extending bumper and a pair of plow support members extending outwardly from said end of said motor vehicle beyond said horizontally extending bumper and terminating in respective spaced and aligned first ends thereof, said spaced and aligned first ends each having a flat surface having a hole extending therethrough;

a hollow horizontally extending cap spaced outwardly from said horizontally extending bumper said hollow horizontally extending cap including a flat horizontal top wall, a flat vertical front wall, flat vertical opposing side walls extending from said flat horizontal top wall and said flat vertical front wall, a rear wall extending from said flat horizontal top wall and perpendicular thereto, and a bottom wall extending from said flat vertical front wall and perpendicular thereto, the edge of each of said flat vertical opposing side walls extending from said flat vertical front wall having a partly vertical and partly angled edge, said flat vertical front wall having a portion extending from each of said partly vertical and partly angled edges, said respective portions including a vertical surface extending the length of said partly vertical edge and an angled surface extending the length of said partly angled edge, the combination of said portions of said flat vertical front wall, said flat vertical opposing side walls extending from said respective portion and said flat horizontal top wall being enclosed around respective of said spaced and aligned first ends;

at least one of said flat horizontal top wall, said flat vertical front wall and said flat vertical opposing side walls having holes extending therethrough, said at least one flat wall holes being aligned and adjacent said holes in said flat surface of said spaced and aligned first ends, and means for securing said at least one flat wall to said flat surface through said at least one flat wall holes and said flat horizontal surface holes.

* * * * *